US008378806B2

(12) United States Patent
Piccolo, III

(10) Patent No.: US 8,378,806 B2
(45) **Date of Patent: *Feb. 19, 2013**

(54) PSEUDO NON-ADDRESSABLE ALARM SYSTEM

(75) Inventor: Joseph Piccolo, III, Fitzwilliam, NH (US)

(73) Assignee: SimplexGrinnell LP, Westminster, MA (US)

( * ) Notice: Subject to any disclaimer, the term of this patent is extended or adjusted under 35 U.S.C. 154(b) by 337 days.

This patent is subject to a terminal disclaimer.

(21) Appl. No.: 12/884,818

(22) Filed: Sep. 17, 2010

(65) Prior Publication Data

US 2012/0068841 A1 Mar. 22, 2012

(51) Int. Cl.
*G08B 23/00* (2006.01)
*G08B 29/00* (2006.01)

(52) U.S. Cl. ..... 340/501; 340/506; 340/505; 340/514; 340/508; 340/9.11; 340/10.32

(58) Field of Classification Search ..... 340/501, 340/505, 9.1, 9.11
See application file for complete search history.

(56) References Cited

U.S. PATENT DOCUMENTS

| | | | | |
|---|---|---|---|---|
| 5,515,034 | A * | 5/1996 | Otsuka et al. | 340/9.11 |
| 6,313,744 | B1 | 11/2001 | Capowski et al. | |
| 6,426,697 | B1 | 7/2002 | Capowski et al. | |
| 7,026,949 | B2 * | 4/2006 | Lee et al. | 340/9.1 |
| 7,369,037 | B2 | 5/2008 | Piccolo, III et al. | |
| 7,378,966 | B2 * | 5/2008 | Agarwal et al. | 340/572.1 |
| 2004/0046642 | A1 * | 3/2004 | Becker et al. | 340/10.32 |
| 2004/0051739 | A1 | 3/2004 | Schmickley et al. | |
| 2007/0008099 | A1 | 1/2007 | Kimmel et al. | |
| 2009/0091466 | A1 | 4/2009 | Sendrowski | |
| 2010/0315224 | A1 | 12/2010 | Orsini et al. | |
| 2012/0068842 | A1 * | 3/2012 | Piccolo, III | 340/501 |
| 2012/0154160 | A1 * | 6/2012 | Piccolo, III | 340/628 |

FOREIGN PATENT DOCUMENTS

| | | | |
|---|---|---|---|
| EP | 1 182 630 | | 2/2002 |
| WO | WO2004028115 | A1 | 4/2004 |
| WO | WO 2006/049614 | | 5/2006 |
| WO | WO2009010745 | A1 | 1/2009 |

OTHER PUBLICATIONS

Search Report and Written Opinion issued in corresponding PCT/US2012/042576 dated Aug. 20, 2012 (14 pgs).

* cited by examiner

*Primary Examiner* — Donnie Crosland
(74) *Attorney, Agent, or Firm* — Brinks Hofer Gilson & Lione

(57) ABSTRACT

A pseudo non-addressable alarm system that uses addressable notification appliances and/or detectors is disclosed. In one aspect, the addressable notification appliances and/or detectors may be entirely automatically (or partially automatically) grouped. One manner of automatic grouping is to use the wiring of the pseudo non-addressable system in order to automatically form the groupings of notification applications, such as grouping the notification appliances based on the signal line circuit to which they are connected. In another aspect, labels for the notification appliances and/or detectors in the pseudo non-addressable system may be entirely automatically (or partially automatically) generated. The labels may be automatically generated based on wiring of the pseudo non-addressable system and/or based on grouping information (such as grouping based on the particular signal line circuit to which the notification appliance is connected).

19 Claims, 4 Drawing Sheets

PSEUDO NON-ADDRESSABLE ALARM SYSTEM

BACKGROUND

Typical fire alarm systems include a number of fire detectors positioned throughout a building (and/or campus). Signals from those detectors are monitored by a system controller, such as a fire alarm control panel ("FACP"). The FACP, upon sensing an alarm condition, sends commands to one or more notification appliances to alert occupants in one section of the building, in multiple sections of the building, or in all sections of the building. Notification appliances can output a visual notification, an audible notification, or both. Examples of notification appliances include, but are not limited to strobes, horns, speakers, and the like. Notification appliances are typically connected across common power lines on a notification appliance circuit ("NAC").

Fire alarm systems NACs may be classified as: (1) including non-addressable notification appliances ("non-addressable NAC"); and (2) including addressable notification appliances ("addressable NAC"). Non-addressable notification appliances do not have an address, and, therefore, the FACP cannot communicate with a particular notification appliance. All of the non-addressable notification appliances on a single circuit are activated at the same time, for example by applying power to the circuit. In the addressable system, on the other hand, each notification appliance has a uniquely assigned address, enabling the FACP to send communications to and receive communications from a particular notification appliance.

Each type of fire alarm system has benefits and drawbacks, such as in terms of installation, configuration, and operation. With regard to installation, the non-addressable alarm system is typically more expensive to install in terms of wiring than an addressable alarm system. The non-addressable alarm system is bound to the particular wiring of the system, e.g. a single loop of wiring or linear wiring with each appliance wired in series, so that the wiring may be supervised for open circuit faults. Also, due to the lack of uniquely assigned addresses, notification appliances need to be wired to the proper NAC in order to be properly activated by the FACP. In contrast, an addressable alarm system may be installed without regard to the particular wiring in a building since each appliance is individually supervised to detect open circuit faults. In this way, the installer may lay the wiring as is most convenient (such as by using "T" taps).

With regard to configuration, the addressable alarm system requires much more manpower than the non-addressable alarm system. For example, configuration of the addressable alarm system requires setting a unique address at each notification appliance (such as through switches or other type of means). As another example, configuration of the addressable alarm system requires entering device identification information (such as a label) for each notification appliance. As still another example, configuration of the addressable alarm system may require grouping of the notification appliances. Unlike non-addressable notification appliances (which are activated by modifying the power to the NAC to which they are connected), addressable notification appliances need not be grouped based on wiring. Instead, the group(s) to which each addressable notification appliance is to be assigned be manually designated so that the FACP can simultaneously turn a group of addressable notification appliances on/off at the proper times. Such a grouping is called a virtual NAC ("VNAC"), with each of the addressable notification appliances in the VNAC being "turned on" by the FACP, preferably using a single group-directed command.

With regard to operation, the addressable alarm system has advantages over the non-addressable alarm system. As merely one example, advanced diagnostics are available in the addressable alarm system that are not available in the non-addressable alarm system. For example, the FACP may send a command to an addressable notification appliance to perform a self-test. The addressed notification appliance may perform the self test, and then report back the results of the test to the FACP.

Even though installation is easier and operation is better using an addressable alarm system, a majority of fire alarm systems are non-addressable because configuring an addressable alarm system is so much more time-consuming and expensive.

SUMMARY

The present embodiments relate to a pseudo non-addressable alarm system that uses addressable notification appliances and/or detectors in a hybrid system. With regard to installation, the pseudo non-addressable alarm system may be installed similarly to an addressable alarm system (including the ability to use "T" taps). This is due to the pseudo non-addressable system having the notification appliances be addressable (such as with the system controller having the ability to individually address a particular notification appliance using an address that is unique to the particular notification appliance).

With regard to configuration, the pseudo non-addressable system has a simpler configuration than an addressable system, and has a configuration akin to a non-addressable system. In one aspect, groupings of the notification appliances and/or detectors in the pseudo non-addressable system are configured entirely automatically (or partially automatically). One manner of automatic grouping is to use the wiring of the pseudo non-addressable system in order to automatically form the groupings of notification applications (such as grouping the notification appliances based on the signal line circuit to which they are connected). For example, the method or system may communicate with a plurality of the notification appliances, and automatically create at least one grouping for one or more notification appliances based at least in part on wiring in the alarm system for one or more notification appliances. In particular, the alarm system can include a signal line circuit, and the automatic creating of the grouping includes automatically grouping the notification devices connected to the signal line circuit.

The alarm system may include an alarm panel, wiring, and the notification appliances. The alarm panel may include one or more input/output ports, with wiring connecting one or more notification appliances to the input/output ports. For example, wiring on the first floor of a building may be connected to one input/output port (such as input/output port #1) of the alarm panel. The notification appliances that are connected to the wiring on the first floor may be grouped in a single grouping, with an indicator such as "first floor"; "zone 1"; "#1"; or "input/output port #1". The indicator may be automatically created or created using operator input. Thereafter, the alarm panel may communicate with the grouping in several ways. One way is to send a command to a particular input/output port (such as input/output port #1) when the alarm panel wishes to communicate with the notification appliances on the wiring connected to the particular input/output port. Another way is to send a indication to the notification appliances on the particular input/output port instructing the appliances that they are on a particular grouping (such as "#1") so that when a subsequent command includes the particular grouping (such as "#1"), the notification appliance can respond to the particular command. Thereafter, the alarm panel may broadcast a command with the particular grouping (such as "#1") so that only the appliances previously assigned the grouping (such as grouping "#1") only respond to the command. Several types of communication are contemplated, including communication to automatically assign unique addresses.

In another aspect, labels for the notification appliances and/or detectors in the pseudo non-addressable system are generated entirely automatically (or partially). The labels may be automatically generated based on wiring of the pseudo non-addressable system and/or based on grouping information (such as grouping based on the particular signal line circuit to which the notification appliance is connected). The automatic generation of the label may be based on operator input or not based on any operator input. For example, the notification devices associated with a particular input/output port (such as input/output port #1) may be automatically assigned the label "1". Or, the operator may input that the wiring to the particular input/output port is associated with a particular part of the building (such as the $1^{st}$ floor), and the automatic label may assign "$1^{st}$ floor" as the label to each of the notification appliances in communication with the particular input/output port. The labels may also be automatically generated based on topology of the notification appliance within the pseudo non-addressable system, based on the unique address of the notification appliance, and/or based on auto-addressing sequence information for the notification appliance.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

DETAILED DESCRIPTION

Figure 1:
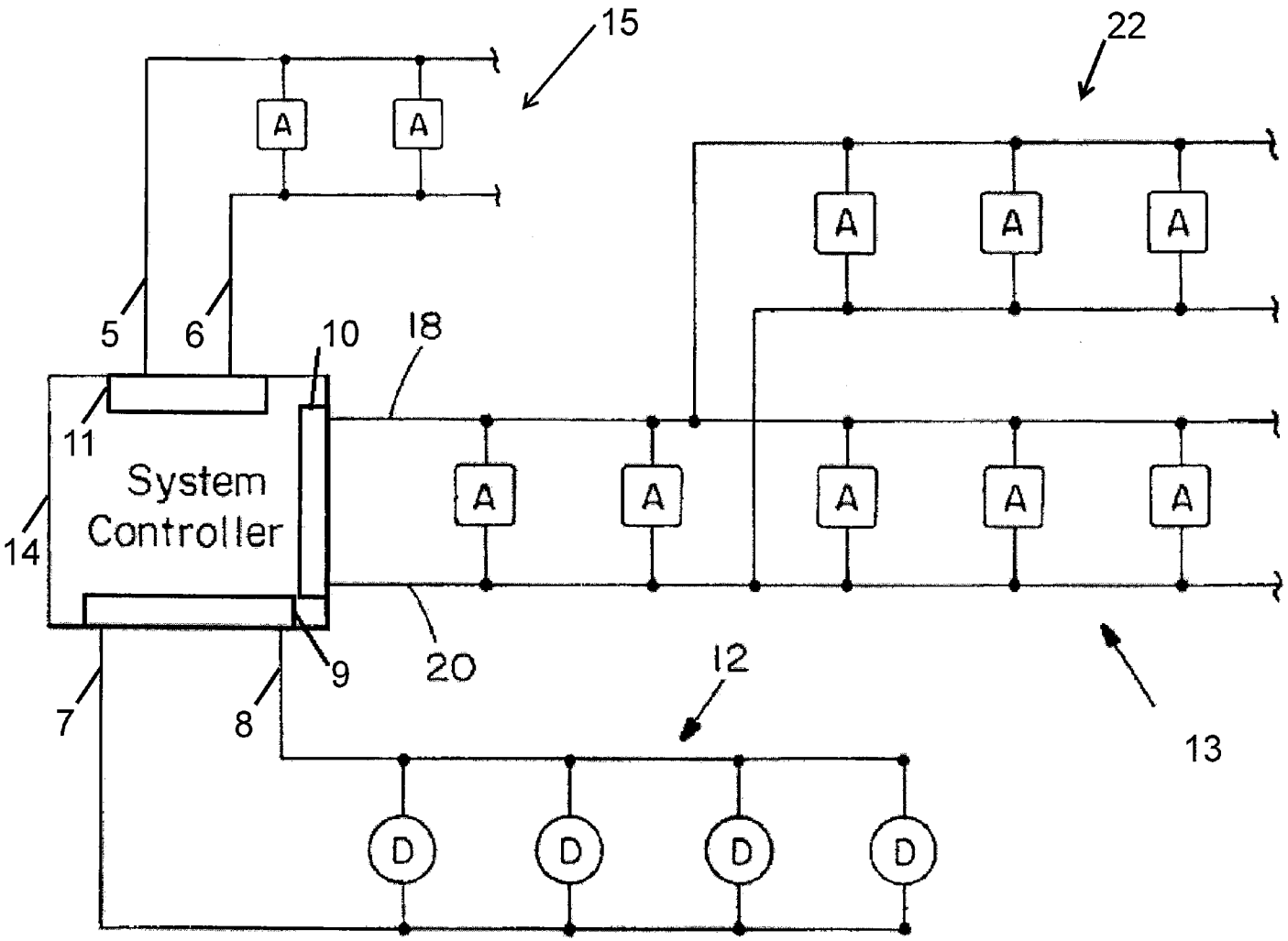
FIG. 1 is a schematic diagram illustrating a system configuration.

A system embodying one example of the present invention is illustrated in FIG. 1. The system includes a system controller 14 (such as a fire alarm control panel (FACP)), alarm condition detectors D, and alarm system notification appliances A. The system may be configured in different ways, such as depicted in FIG. 1.

FIG. 1 further depicts two appliance circuits 13, 15. However, a fewer or a greater number of appliance circuits may be used in the alarm system. FIG. 1 further depicts one detector circuit 12. However, a greater number of detector circuits may be used in the alarm system. The appliance circuits 13, 15 and the detector circuit 12 include one or more wires that emanate from output input/ports 9, 10, 11 of the system controller 14. More specifically, one, some, or all of the wiring for an appliance circuit may emanate from an input/output port 9, 10, or 11 of the system controller 14. As discussed below, the wiring emanating from the input/output port may be used in the automatic configuration described herein.

The example in FIG. 1 depicts that all of the notification devices on a signal output circuit are coupled across a pair of power lines, such as 4 and 5, 6 and 7, 18 and 20, although this is not necessary for carrying out the invention. Lines 4 and 5 may carry communications between the system controller 14 and notification devices A on appliance circuit 15. Lines 18 and 20 may carry communications between the system controller 14 and notification devices A on appliance circuit 13. And, lines 6 and 7 may carry communications between the system controller 14 and detectors D on detector circuit 12.

The appliance circuits may have alarm condition detectors D, alarm system notification appliances A, or both alarm condition detectors D and alarm system notification appliances A. For example, FIG. 1 depicts detector circuit (DC) 12 that includes alarm condition detectors D. Though FIG. 1 depicts only a single detector circuit 12, multiple detector circuits may be included in the system configuration. As still another example, FIG. 1 depicts two notification appliance circuits (NAC) 13, 15 that includes alarm system notification appliances A. As still another example, the alarm system may include a detector/notification appliance circuit (D/NAC) that includes both alarm condition detectors A and alarm system notification appliances A. Again, FIG. 1 is merely for illustration purposes. Fewer or greater numbers of appliance circuits may be used, fewer or greater NACs may be used, fewer or greater DCs may be used, and, one or multiple D/NACs may be used.

The system may further include one or more single-ended stub circuits 22, such as shown in FIG. 1. The use of stub circuits 22, also referred to as "T-tapping", provides a number of advantages, such as reducing the wire material and installation costs, and allowing for increased NAC wiring distances.

The system controller 14 may monitor the alarm condition detectors D. When an alarm condition is sensed, the system controller 14 may signal the alarm to the appropriate notification appliances A through the one or more appliance circuits. Notification devices may include, for example, a visual alarm (such as a strobe), an audible alarm (such as a horn), or a combination thereof. Also, a speaker for broadcasting live or prerecorded voice messages and a strobe may be combined into a single unit (S/V device). A visible indicator (such as an LED) may be provided on any of the above-described notification appliances A, with the LED also being controlled by the system controller 14. For example, the LED may be operated under NAC commands (described below) such that the LED blinks every time the notification appliance A is polled.

The system controller 14 may use one or more commands to signal the alarm to the appropriate notification appliances A. Examples of commands issued for a system with addressable notification appliances are disclosed in U.S. Pat. No. 6,426,697, which is hereby incorporated by reference in its entirety. Further, the system controller 14 may send one or more commands relating to diagnostics, status, or other non-alarm type events. For example the system controller 14 may send a command related to the identification, the configuration, and/or the status of the notification appliances A. And, the notification appliances A may respond in kind.

The command from the system controller 14 can, for example, be multiplexed onto the device's power line (such as lines 18 and 20), providing the added benefit that it saves the cost of additional wiring to devices. Alternatively, the communication line to the device may be separate from the power line. The communications channel may comprise, for example, a wireless link, a wired link or a fiber optic link.

Figure 2:
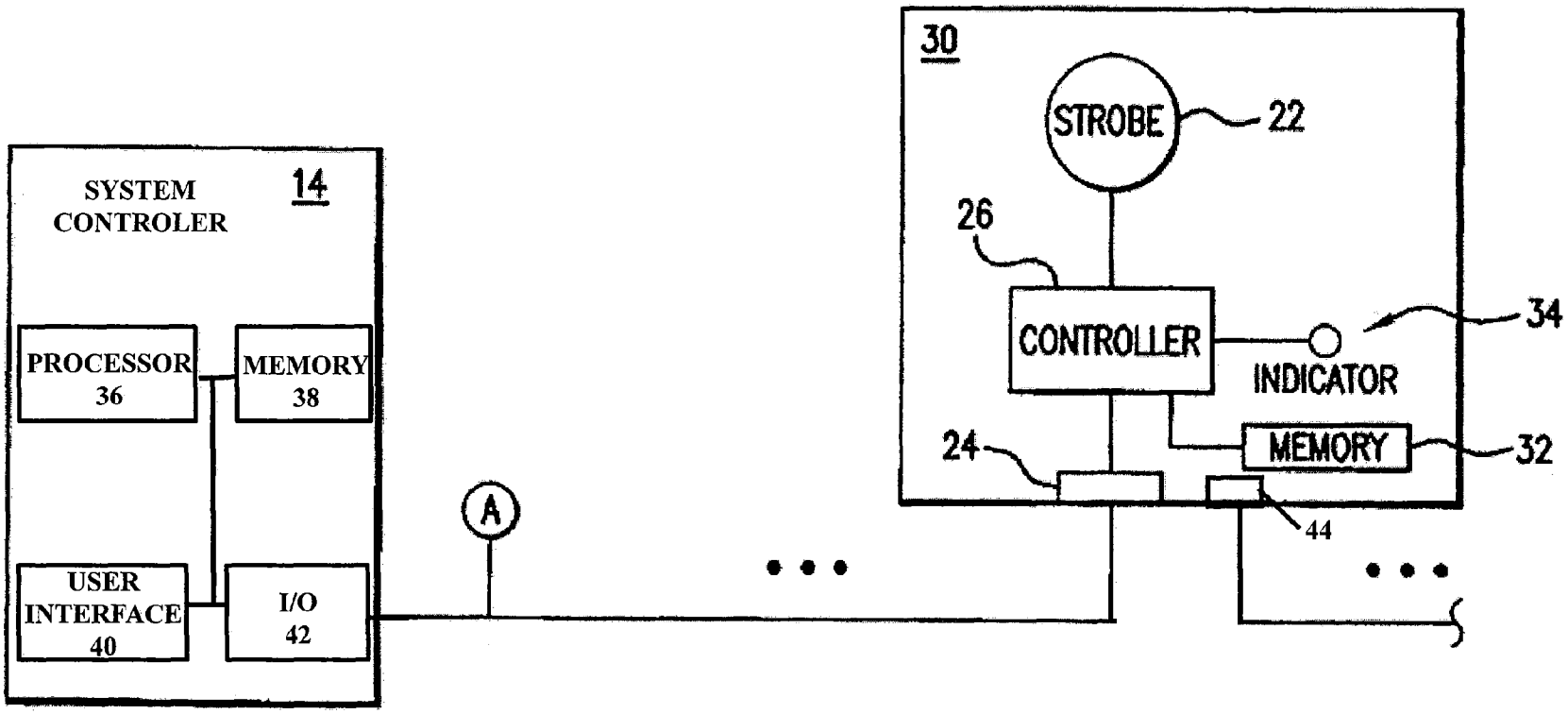
FIG. 2 is a schematic diagram of a part of the system shown FIG. 1, further illustrating details of the system controller and one of the notification appliances.

FIG. 2 is a schematic diagram of a part of the system shown in FIG. 1, further illustrating details of the system controller 14 and one of the notification appliances. The system controller 14 includes a processor 36, a memory 38, a user interface 40, and I/O 42. The processor 36 may comprise a microprocessor, a microcontroller, a digital signal processor, an application specific integrated circuit (ASIC), a field programmable gate array, a logical digital circuit, or other now known or later developed logical processing capability. The processor 36 may work in combination with the memory 38 in order to monitor part or all of the fire alarm system, including one or more of the appliance circuits. In addition, the memory may include one or more look-up tables (or other data structures) used for configuration. Though not necessary to practice the invention, a look-up table correlating the input/output ports 9, 10, 11 to the areas of the building may be stored in memory 38 (such as correlated to $1^{st}$ Floor, $2^{nd}$ Floor, and $3^{rd}$ Floor, respectively). This look-up table may be manually entered. Further, the processor 36 may execute instructions to perform the flow diagrams as disclosed in FIGS. 3-4.

User interface 40 may be used by an operator to control configuration and/or operation of the alarm condition detectors D and alarm system notification appliances A. And, I/O 42 may be an example of a communications interface, and may comprise the interface between the system controller 14 and the alarm condition detectors D and alarm system notification appliances A in the appliance circuit. For example, I/O 42 may include one or multiple input/output ports (illustrated as 9, 10, 11 in FIG. 1).

FIG. 2 depicts a strobe device 30 in greater detail. However, the illustration of strobe device 30 is merely for illustration purposes. Other alarm system notification appliances A, or alarm condition detectors D may be used. Strobe device 30 connects to the appliance circuit via a network interface (communication connection) 24. A controller 26, such as a microcontroller or hardwired logic, receives from and sends to the system controller 14 communications. When commanded by the system controller 14, the strobe 22 of strobe device 30 flashes at a configured setting, which may be stored in a memory (volatile or non-volatile) 32. Although shown separately, the memory 32 may be integrated with the controller 26.

In some embodiments, an indicator 34, such as a flashing LED, may be used as an output, for example during diagnostic testing, on the strobe device 30. The indicator 34 may be activated, for example, upon command from the system controller 14, upon a local manual command such as a pushbutton (not shown), on a periodic basis, always, or upon some other event, as discussed below. Strobe device 30 may further include an isolator 44. Isolator 44 may be used to essentially disconnect other notification appliances wired further from the system controller 14 such that they are unable to receive messages from the system controller 14.

Figure 3:
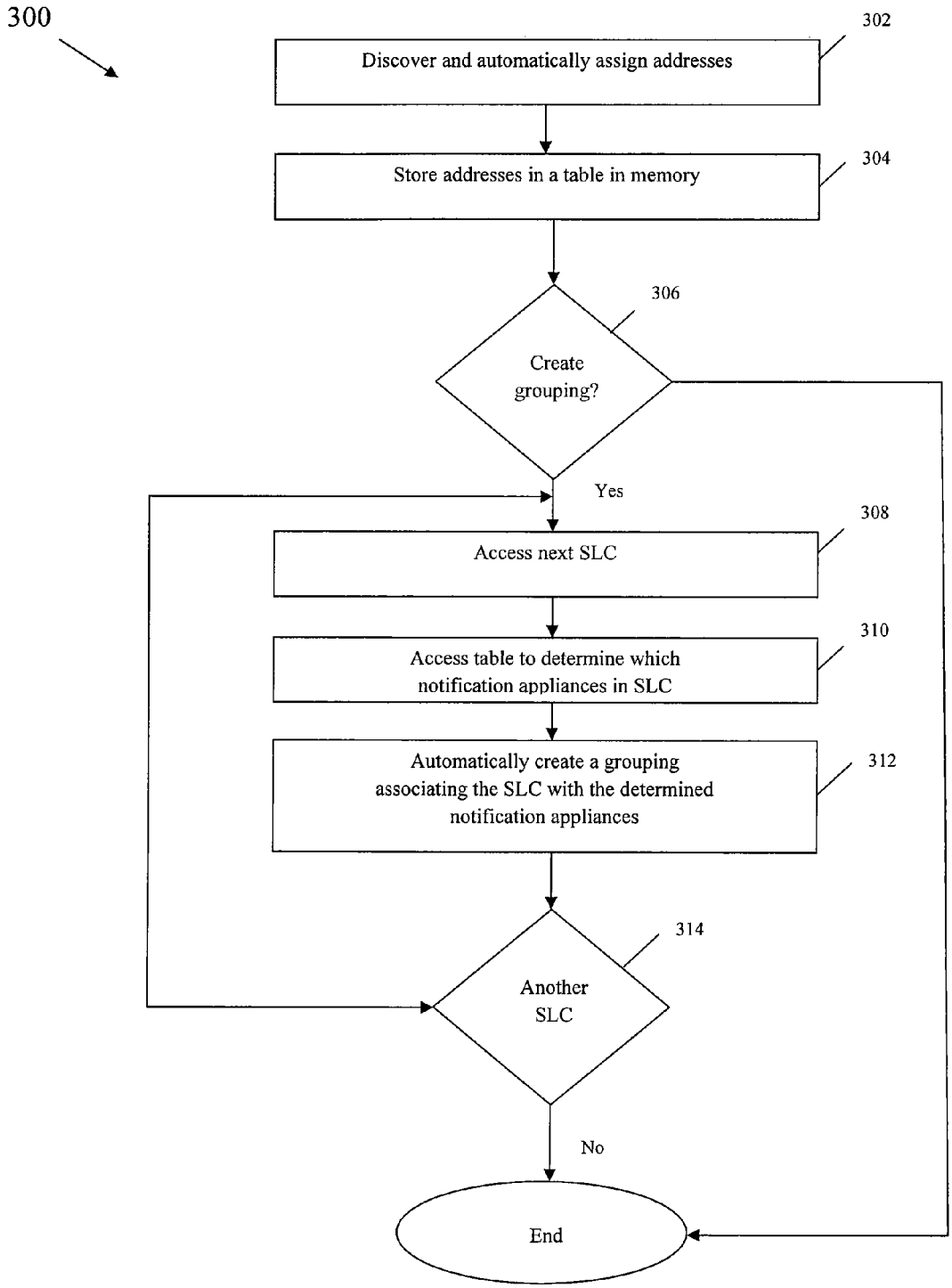
FIG. 3 illustrates a first flow chart for automatically grouping one or more notification appliances.
Figure 4:
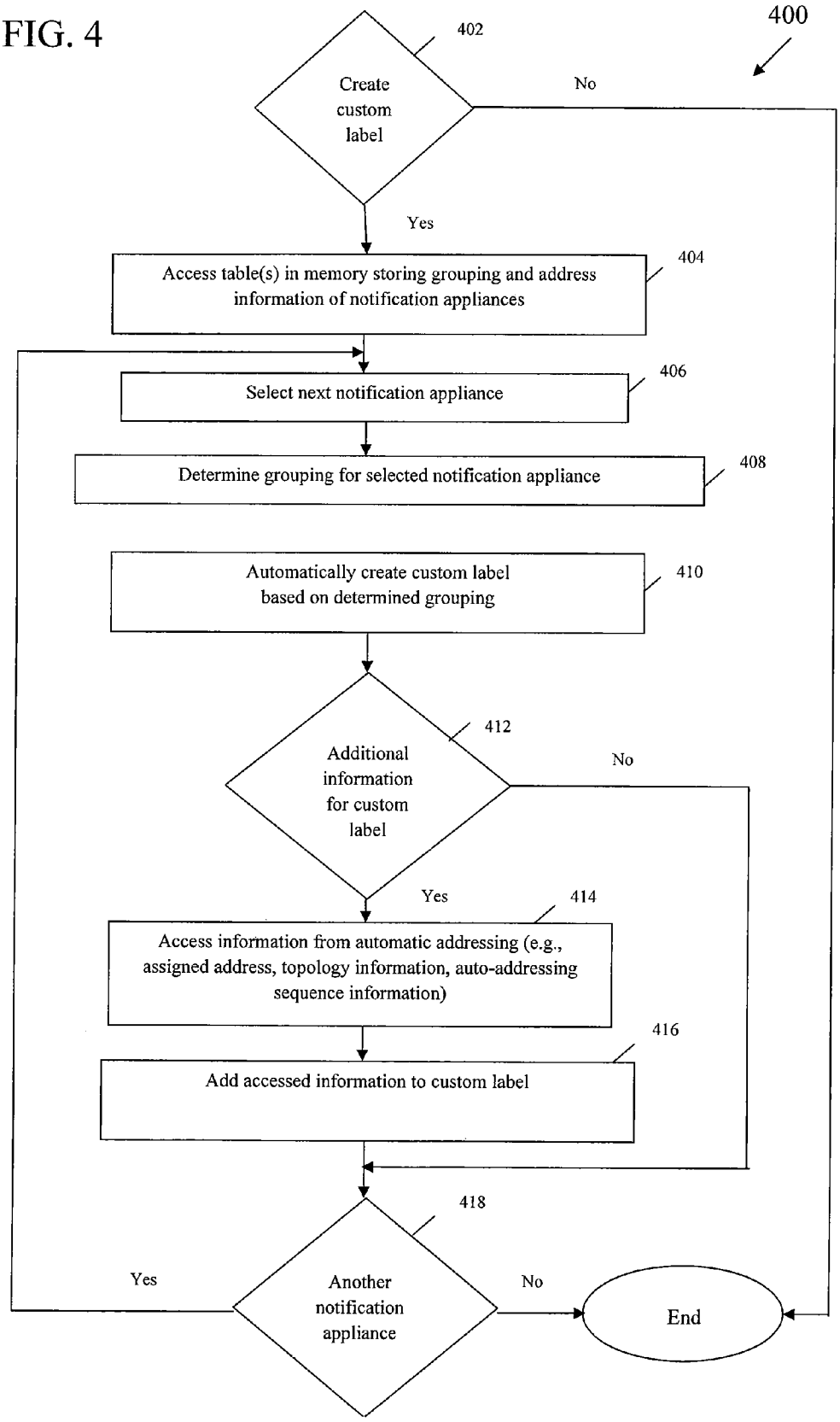
FIG. 4 illustrates a second flow chart for automatically labeling one or more notification appliances.

The basic approach as described in the flow charts in FIGS. 3 and 4 is different from the prior art as described in the Background section. The prior art view addressability as an all-or-nothing proposition, namely that addressability requires at least some manual configuration of labels for the notification appliances and manual configuration of the VNACs. Otherwise, according to the prior art, an addressable alarm system was impossible to configure. In contrast, manual configuration is not necessary, as disclosed below. However, manual configuration may be used in combination with the automatic configuration described here.

Typically, there are three issues in configuring an addressable system.

First, unique addresses are usually manually set at the notification appliances. This entails additional work, both in terms of generating site plans to assign addresses to each of the notification appliances as well as manually configuring the address switches at each notification appliance.

Second, according to the prior art, the installer must configure custom labels to identify each of the notification appliances in the alarm system. The custom label is a description, in words, numerals or other characters, of the location of the notification appliance (such as "$5^{th}$ floor conference room"). The process of assigning custom labels is very labor intensive. For example, if there are 35-50 notification appliances in the alarm system, the installer must assign custom labels to each of them. This entails examining each notification appliance, looking up its unique address, and then typing up a custom label. Apart from being difficult, there are times when it is not even possible to assign custom labels. More specifically, if the alarm system is being installed when a building is being built, the custom labels may not be assigned. In the example of the "$5^{th}$ floor conference room", if the conference room has not been finished, the custom labeling may not be finished until after the floor is completed, delaying configuring the alarm system.

Third, according to the prior art, virtual NACs must be manually configured. Unlike a non-addressable system which applies power to the pair of wires to activate the connected notification appliances, the addressable system activates the notification appliances by applying power and sending a communication (which includes one or more addresses). Manually configuring a virtual NAC provides a shorthand way to indicate which notification appliances need to be activated. For example, the operator may manually group all of the appliances located on the $5^{th}$ floor in a single virtual NAC.

Unlike the prior art, the processes described herein enable at least partly automatic (and in one embodiment, fully automatic) configuration of the labels for the notification appliances and/or configuration of the VNACs. For example, after installation of the notification appliances and the detectors, the FACP may automatically assign labels to one, some, or all of the notification appliances, and may automatically group some or all of the notification appliances into one or more VNACs. The processes described herein may be used in combination with an automatic assignment of addresses for one, some, or all of the notification appliances. Likewise, the processes described herein may be used in combination with an automatic assignment of addresses for one, some, or all of the detectors. More specifically, the processes described below focus on automatic addressing of notification appliances, automatic grouping of notification appliances, and automatic labeling of notification appliances. Similarly, the processes may be applied to automatically assigning of addresses to one, some or all of the detectors. And, the processes may be applied to automatically grouping some or all of the detectors based on the wiring. Further, the processes may be applied to automatically labeling some or all of the detectors based on the wiring and/or based on the grouping.

Referring to the flow charts, FIG. 3 illustrates a first flow chart 300 for automatically grouping one or more notification appliances. At block 302, the FACP discovers and automatically assigns addresses. Next, at block 304, the unique addresses may be stored in a table (or other data structure) in memory (such as memory 38). Along with the unique addresses, the signal line circuit (SLC) to which the notification appliances is connected may be stored as well. More specifically, at least one aspect of the wiring of the system related to one or more SLCs are stored. One example of the aspect of the wiring of the system may include a look-up table (or other data structure) that correlates input/output ports with sections of a building. As discussed above, multiple input/output ports (such as 9, 10, and 11 depicted in FIG. 1) may be used. The look-up table may correlate a particular port, such as input/output port 10, 11, with a section of the building, such as the lobby, $2^{nd}$ floor. In this way, the different ports may be correlated with wiring in different sections of the building. And, this information may be used in subsequent automatic configuration, as discussed in more detail below.

The assigned address may be unique for a part of the alarm system (such as a branch of wires) or may be unique to the entire alarm system. See PCT Published Application No. 2009/010745 A1, incorporated by reference in its entirety.

An exemplary method for automatically assigning addresses uses a unique number (for example, a serial number or other unique identifier) inside the notification appliance. The unique number may be stored in a memory (such as memory 32) upon manufacture. The system controller 14 may broadcast a series of messages. For example, the system controller 14 may first broadcast a message requesting all notification appliances that have not been assigned a unique address to respond if the notification appliance has a unique number with a last digit of "0". If the system controller 14 receives via I/O 42 a coherent response, only one notification appliance responded. In this case, the system controller sends a follow-up message that the notification appliance with the unique number with a last digit of "0" is assigned some unique address "XX". The system controller 14 may save the unique address "XX" and associate it with the SLC from which the communication was sent in memory 38. If the system controller 14 receives via I/O 42 an incoherent response, then more than one notification appliance responded. The system controller 14 may then send a subsequent broadcast message, requesting the notification appliances that have not been assigned a unique address to respond if the notification appliance has a unique number with a last two digits of "10". If only one appliance responds, then the system controller 14 assigns a unique address YY. This procedure may be done iteratively until all of the notification appliances have been assigned a unique address. Of course, one skilled in the art would recognize that other techniques for discovering notification appliances or other devices on an NAC or SLC and assigning addresses may be used.

Another example of a methodology to automatically assign addresses is by using isolators in the notification appliances. A notification appliance may have an isolator built in (such as isolator 44) so that the notification appliance may essentially disconnect the NAC from further notification appliances such that they are unable to receive messages from the FACP. When the alarm system starts up (such as if the notification appliance does not have a unique address assigned to it), the system may be configured so that all of the notification appliances trip their respective isolators. In this way, the only notification appliance that is actually connected to the system controller 14 is the first notification appliance on the SLC. The system controller 14 can communicate with that first appliance and assign it a unique system address. More specifically, the system controller 14 may send a broadcast command (which will only be received by the first appliance) such that if the notification appliance does not have a unique address, it is assigned a unique address, say "01". The notification appliance then closes its isolator, enabling contact between the FACP and the next notification appliance in line. The system controller 14 may repeat the process by broadcasting a command that recites "all notification appliances that do not have unique system addresses will be labeled appliance "02". And, the system controller 14 may store both the unique address and the associated SLC in memory 38. The notification appliance with the unique address of "02" then may close its isolator. The process may be repeated until every one of the notification appliances has a unique system address.

At block 306, it is determined whether groupings are to be created. If not, the method ends. If so, at block 308, the next signal line circuit (SLC) is accessed. In the case of the first pass of the loop shown in flow chart 300, the first SLC is the "next" SLC. For example, the SLC connected to input/output port 10 may be accessed first. A fire alarm control panel may have one or more SLCs. Depending on the protocol used, an SLC can monitor and control several hundred devices. The devices connected to each SLC, which can number from a few devices to several hundred, for example, may be polled. Further, a fire alarm system may have multiple SLCs, with the SLCs being further divided into sub-groups, such as through the use of fault-isolation modules.

Each device on a SLC may be assigned its own unique address (such as via block 302), such that the system controller 14 may individually address each of the devices. Addressable devices include, but are not limited to, notification appliances, detectors such as smoke detectors, heat detectors, manual call points, manual pull stations, responders, fire sprinkler system inputs, switches (including flow control, pressure, isolate, and standard switches), and output devices (e.g., relays, such as warning system/bell relays, door holder relays, auxiliary (control function) relays), etc.

For example, a fire alarm system may be installed in a 4-story building, with there being four SLCs (SLC#1 for the first floor, SLC#2 for the second floor, SLC#3 for the third floor, and SLC#4 for the fourth floor). Each of the SLCs may have its wiring emanate from a different input/output port of I/O 42 in the system controller 14. And, a look-up table may correlate the input/output ports with the sections of the building. For example, a first input/output port may define SLC#1, and may be correlated to the first floor. A second input/output port may define SLC#2, and may be correlated to the second floor, and so on. Or, the SLCs may be automatically assigned to "zone 1", "zone 2", etc.

At block 310, the table which contains the unique addresses of the notification appliances and the SLC to which each notification appliance is connected is accessed. The system controller 14 may automatically create a grouping associating all of the notification appliances on a particular SLC, as shown at block 312. In this way, an indicator of the grouping may be correlated with the unique addresses for the determined notification appliances connected to the signal line circuit. And, the grouping may be stored in the table (or other data structure) in the memory 38 that also stores the unique address information. Alternatively, the grouping may be stored in a table (or other data structure) in the memory 38 that is separate from the table that stores the unique address information. The grouping may comprise a VNAC. In the 4-story building example, all of the notification appliances connected to SLC#1 may be grouped together in a VNAC. The grouping may include an indicator of associated with SLC#1 (such as "Group SLC#1" or "Group $1^{st}$ floor"). Likewise, all of the notification appliances connected to SLC#2 may be grouped together in a VNAC identified as "Group SLC#2" or "Group $2^{nd}$ floor". At block 314, the process checks whether there are any other SLCs. If so, control loops back to block 308 and selects the next SLC. If there are no other SLCs, the process ends.

In this way, the notification appliances may be automatically grouped according to which SLC each notification appliance is connected. Further, the system controller 14 has the ability to create a virtual NAC based on the configuration wiring. The reliance on the wiring for the automatic grouping reduces the amount of programming needed to create a virtual NAC, in effect reducing the effort to group notification appliances to approximately that of a non-addressable system.

FIG. 4 illustrates a process 400 for automatically labeling one or more notification appliances. At block 402, it is determined whether to create one or more custom labels. If not, the method ends. If so, at block 404, the one or more tables in memory 38 that store grouping and/or address information are accessed. The next notification appliance is selected, at block 406. In the case of the first pass of the loop shown in flow chart 400, the first notification appliance in the table may be accessed. At block 408, based on the one or more tables, the grouping information is determined for the selected notification appliance. For example, a notification appliance may be on "Group 1$^{st}$ floor", as discussed above.

At block 410, a custom label is automatically created based on the determined grouping. The custom label may comprise an indicator of the determined grouping. The automatically created label may then be stored in the one or more tables. Or, the automatically created label may be stored in a separate section in memory 38. So, in one aspect, the automatically created label may comprise only "zone" information. The zone information may be based on the wiring or the SLC, so that the specificity of the label is dependent on the specificity of the wiring. For example, a particular SLC may be connected to a specific input/output port. Without any additional data, each notification appliance on the particular SLC may be automatically assigned a particular label, such as "Zone 1". As another example, if the particular SLC is connected to a specific input/output port, with the specific input/output port previously designated as "1$^{st}$ Floor", the automatically created label may be for "1$^{st}$ floor". As another example, if the SLC is dedicated to the lobby on the first floor, automatically created label may be for "lobby—1$^{st}$ floor". In this way, the wiring may dictate, at least in part, the automatic creation of the label.

Moreover, additional information may be added to (or be used in place of) the grouping information when automatically creating a custom label, as discussed below. At block 412, it is determined whether to add additional information to the custom label. If yes, information is accessed that was generated during automatic addressing, as shown at block 414. At 516, the accessed additional information may be added to the automatically created custom label.

For example, the assigned address may be accessed from the one or more tables. The automatically created custom label may include the grouping information and the unique address of the notification appliance. For example, the automatically created custom label may include "lobby—1$^{st}$ floor; 01" or other unique information, e.g., "lobby—1$^{st}$ floor #1". As another example, topology of the system may be used. Topology information may comprise the sequence or order of notification appliances along an SLC. For example, the notification appliance closest to the fire alarm control panel may be designated the "first" notification appliance. The notification appliance second closest to the fire alarm control panel may be designated the "second" notification appliance, and so on. Using isolators when automatically assigning unique address allows for the determination of this type of topology information, so that during the automatic assigning of unique addresses, the topology information may likewise be stored in the tables, to be used for the creation of the automatically created custom labels. As still another example, the sequence information for assigning of notification appliances may be accessed. In particular, the sequence by which the unique addresses are assigned (such as the fifth appliance to receive a unique address) may be stored in the table for later access when automatically generating the custom labels.

At block 418, the process 400 checks whether there is another other notification appliance. If so, control loops back to block 406 and selects the next notification appliance. If there are no other notification appliances, the process ends.

After the automatic configuration, the operation of the pseudo non-addressable system may improve the operation of the alarm system. As one example, the system controller 14 may send a query, using the table listing the unique addresses, to a particular notification appliance, requesting configuration data of the particular notification appliance. In response, the addressed notification appliance may send its current configuration. As another example, the system controller 14 may use the processes described herein for diagnostic purposes. A notification appliance failing typically results in one of two situations: (1) the notification appliance is able to communicate and can function sufficiently to be identified (e.g., the notification appliance can receive a command and generate an aural and/or visual output identifying itself); or (2) the notification appliance is unable to communicate with the system controller or cannot function sufficiently to be identified.

In the first situation, the system controller 14 may send a command (such as a diagnostic command) to the notification appliance to generate an output, such as switching on indicator 34. The automatically generated custom labels may be used to assist a technician by directing the technician to the general area of the notification appliance (e.g., a custom label may indicate "lobby—1$^{st}$ floor). The technician may examine the notification appliances in the area (such as in the lobby—1$^{st}$ floor) to determine which notification appliance is generating the requested output. Specifically, the technician may notice that a particular notification appliance is generating an output via indicator 34, enabling the technician to identify the malfunctioning appliance.

In the second situation, the system controller 14 may identify (using the one or more tables) the VNAC to which the malfunctioning notification appliance belongs, and send a command to all of the notification appliances on the VNAC (except the malfunctioning notification appliance). The technician may use the automatically generated custom labels to go to the general vicinity of the defective notification appliance (such as lobby—1$^{st}$ floor), and the technician may examine the notification appliances in the area (such as in the lobby—1$^{st}$ floor) to determine which notification appliance is not generating the requested output. Specifically, the technician may notice that a particular notification appliance is the only appliance in the general vicinity that is not generating an output (such as an output with indicator 34). In this way, the diagnostics may combine a partly automated (using automatic addressing, automatic grouping, and/or automatic labeling) and partly manual solution (using the technician) in order to identify a malfunctioning notification appliance.

While the discussion above focuses on notification appliances, one, some, or all of the detectors in the fire alarm system may be subject to automatic addressing, automatic grouping, and/or automatic labeling. Typically, detectors are provided unique addresses and manually given a custom label. Using the methodology as described above, the detectors may be automatically grouped into a particular "zone" using the wiring that is used to communicate with the detectors. Identifying a detector as part of a zone may provide sufficient information. For example, a firefighter may be more interested in knowing which zone had a detector that activated, rather than a specific address of the activated detector (which may provide too much information to the firefighter).

Instructions for configuring the pseudo non-addressable system in the processes discussed above may be stored on any computer readable medium. As used herein, a "computer readable medium" includes, but is not limited to, non-volatile media, and volatile media. Non-volatile media may include, for example, optical disks, and magnetic disks. Volatile media may include, for example, semiconductor memories, and dynamic memory. The computer readable medium may be any non-transitory medium. Common forms of a computer readable medium may include, but are not limited to, a floppy disk, a flexible disk, a hard disk, a magnetic tape, other magnetic medium, an application specific integrated circuit (ASIC), a compact disk CD, other optical medium, a random access memory (RAM), a read only memory (ROM), a memory chip or card, a memory stick, and other media from which a computer, a processor or other electronic device can read.

Instructions for controlling or commanding a device in the process discussed above, such as disclosed in FIGS. 3-4, may be stored on any logic. As used herein, "logic", includes but is not limited to hardware, firmware, software in execution on a machine, and/or combinations of each to perform a function (s) or an action(s), and/or to cause a function or action from another logic, method, and/or system. Logic may include, for example, a software-controlled microprocessor, an ASIC, an analog circuit, a digital circuit, a programmed logic device, and a memory device containing instructions.

Although specific embodiments have been described and illustrated, the invention is not to be limited to the specific forms or arrangements of parts so described and illustrated. The scope of the invention is to be defined by the claims appended hereto and their equivalents. It is intended that the foregoing detailed description be understood as an illustration of selected forms that the invention can take and not as a definition of the invention. It is only the following claims, including all equivalents, which are intended to define the scope of this invention.

The invention claimed is:

1. A method for configuring an alarm system, the method comprising:

communicating with one or more notification appliances; and automatically creating at least one grouping for the one or more notification appliances based at least in part on wiring in the alarm system of the notification appliances.

2. The method of claim 1, wherein communicating with the one or more notification appliances comprises communicating with a particular notification appliance based on a unique address for the particular notification appliance.

3. The method of claim 2, further comprising automatically generating unique addresses for the one or more notification appliances.

4. The method of claim 1, wherein the alarm system comprises a signal line circuit; and wherein automatically creating at least one grouping comprises automatically creating a grouping of the notification devices connected to the signal line circuit.

5. The method of claim 4, wherein automatically creating a grouping of notification devices comprises:

determining the notification appliances connected to the signal line circuit; and correlating an indicator of the grouping of notification devices with the unique addresses for the determined notification appliances connected to the signal line circuit.

6. The method of claim 5, wherein determining the notification appliances connected to the signal line circuit comprises accessing at least one table that correlates the notification appliances with the signal line circuit.

7. The method of claim 1, further comprising:

correlating an indicator with the at least one grouping; and sending a command to the one or more notification devices, the command including the indicator.

8. The method of claim 1, wherein the alarm system comprises an alarm panel with an input/output port;

wherein the wiring of the alarm system is electrically connected to the input/output port; and wherein automatically creating at least one grouping for the one or more notification appliances comprises automatically grouping the one or more notification appliances connected to the wiring.

9. The method of claim 1, further comprising:

automatically creating a label for the one or more notification appliances based on the automatically created grouping.

10. The method of claim 9, wherein automatically creating the label based on the automatically created grouping comprises automatically associating an indication of the created grouping with the one or more notification appliances.

11. The method of claim 10, wherein automatically creating the label further comprises automatically associating topology information for the one or more notification appliances with the indication of the created grouping.

12. The method of claim 9, wherein automatically creating the label further comprises automatically associating a unique address with the indication of the created grouping.

13. A fire alarm control panel comprising:

a communications interface for communicating with one or more notification appliances; and a controller in communication with the communications interface, the controller configured to:

automatically create at least one grouping for the one or more notification appliances based at least in part on wiring in the alarm system of the notification appliances.

14. The fire alarm control panel of claim 13, wherein the controller is further configured to communicate with a particular notification appliance based on a unique address for the particular notification appliance.

15. The fire alarm control panel of claim 14, wherein the controller is further configured to automatically generate unique addresses for the one or more notification appliances.

16. The fire alarm control panel of claim 13, wherein the one or more notification applications are in a signal line circuit; and wherein the controller automatically creates at least one grouping for the one or more notification appliances by automatically creating a grouping of the notification devices connected to the signal line circuit.

17. The fire alarm control panel of claim 13, further comprising an input/output port;

wherein the wiring electrically connects the one or more notification appliances to the input/output port; and wherein the controller is configured to automatically create the at least one grouping for the one or more notification appliances by automatically grouping the one or more notification appliances connected to the wiring.

18. The fire alarm control panel of claim 13, wherein the controller further configured to automatically create a label for the one or more notification appliances based on the automatically created grouping.

19. The fire alarm control panel of claim 18, wherein the controller is configured to automatically creating the label by associating an indication of the created grouping with the one or more notification appliances.

* * * * *